US007793969B2

(12) United States Patent
Wilson

(10) Patent No.: US 7,793,969 B2
(45) Date of Patent: Sep. 14, 2010

(54) SKI WITH SUSPENSION

(75) Inventor: Anton F. Wilson, Glengarry Rd., Croton-on-Hudson, NY (US) 10520

(73) Assignee: Anton F. Wilson, Croton-On-Hudson, NY (US)

( * ) Notice: Subject to any disclaimer, the term of this patent is extended or adjusted under 35 U.S.C. 154(b) by 163 days.

(21) Appl. No.: 11/283,050

(22) Filed: Nov. 21, 2005

(65) Prior Publication Data

US 2006/0145451 A1 Jul. 6, 2006

Related U.S. Application Data

(60) Provisional application No. 60/630,033, filed on Nov. 23, 2004.

(51) Int. Cl.
*A63C 5/07* (2006.01)

(52) U.S. Cl. ..... 280/602; 280/607

(58) Field of Classification Search ..... 280/602, 280/607, 617, 618

See application file for complete search history.

(56) References Cited

U.S. PATENT DOCUMENTS

| | | | | | |
|---|---|---|---|---|---|
| 382,254 | A * | 5/1888 | Conradson | 280/604 |
| 3,260,531 | A | 7/1966 | Heuvel | 280/11.13 |
| 3,863,915 | A * | 2/1975 | Pifer | 482/51 |
| 4,147,378 | A * | 4/1979 | Reich | 280/633 |
| 4,221,400 | A * | 9/1980 | Powers | 280/602 |
| 4,509,227 | A * | 4/1985 | Keane | 16/23 |
| 4,555,651 | A * | 11/1985 | Melocik et al. | 388/828 |
| 5,158,318 | A * | 10/1992 | Dittmar | 280/608 |
| 5,284,357 | A * | 2/1994 | Tinkler | 280/602 |
| 5,294,144 | A * | 3/1994 | Stepanek et al. | 280/612 |
| 5,421,602 | A * | 6/1995 | Stepanek et al. | 280/602 |
| 5,597,170 | A | 1/1997 | Le Masson et al. | 280/602 |
| 5,806,875 | A * | 9/1998 | Bonvallet | 280/602 |
| 5,820,154 | A * | 10/1998 | Howe | 280/602 |
| 5,927,743 | A * | 7/1999 | Mantel | 280/602 |
| 6,158,747 | A * | 12/2000 | Magnani | 280/11.14 |
| 6,220,631 | B1 * | 4/2001 | Pritchard et al. | 280/809 |
| 6,619,688 | B2 * | 9/2003 | Billon et al. | 280/607 |
| 2003/0141700 | A1 * | 7/2003 | Turner et al. | 280/601 |
| 2005/0104328 | A1 * | 5/2005 | Emig et al. | 280/602 |
| 2005/0206128 | A1 * | 9/2005 | Gignoux | 280/602 |

OTHER PUBLICATIONS

Anand, D. K., and Cunniff, P.F., Engineering Mechanics: Statics, 1984, Allyn and Bacon, Inc., pp. 76-77.*

Communication from the U.S. patent office in a counterpart application (Int'l. Search Report from Int'l. App. No. PCT/US05/42129), dated May 21, 2007.

* cited by examiner

*Primary Examiner*—Frank B Vanaman
(74) *Attorney, Agent, or Firm*—Fish & Richardson P.C.

(57) ABSTRACT

Skis and methods of skiing are provided. In some implementations, the skis include a preload, and/or have a relatively low spring rate. In one aspect, the skis include (a) a ski body having a front and a back, the front and back terminating, respectively, at a tip and tail at opposite ends of the ski body; and (b) a suspension system connected to the ski body so as to apply a load to the front and back of the ski body. In some cases, the suspension system is configured to provide the ski with a spring rate that diminishes as the ski is flexed from a normal unloaded state or a predetermined state of deflection to a state of greater deflection.

35 Claims, 12 Drawing Sheets

SKI WITH SUSPENSION

CROSS-REFERENCE TO RELATED APPLICATIONS

This application claims benefit from U.S. Provisional Patent Application No. 60/630,033, filed Nov. 23, 2004, now pending. The entire contents of this application are incorporated by reference herein.

TECHNICAL FIELD

This disclosure relates to skis and methods of skiing, and more particularly to skis for use at downhill ski areas.

BACKGROUND

Recreational alpine skiing, as it is taught and practiced around the world on groomed slopes, is a technique of controlled skidding. The modern ski is designed to skid on the snow in a manner that creates frictional forces that the skier uses to control both speed and direction. Often, a beginning skier is taught how to turn by manipulating pressure on the front and back of the ski unequally in order to create unequal skidding forces. It is the difference between front and back skidding forces that creates the turning moment. Virtually all recreational skiers make use of this basic technique.

The advent of 'shaped' or 'parabolic' skis has provided the alpine skier with an additional technique for turning: carving. Mastering the carved turn using these types of skis involves angulating the ski firmly onto one edge or the other—a technique that most beginning skiers find extremely difficult. The edge should lock into the snow and a specific arc or turn will occur automatically. The incredible control and efficiency of the 'carved turn' has made this technique highly desirable.

Unfortunately, pure carve skiing is difficult to attain as a practical matter. In his classic book "Skiing Mechanics," and again in the 2001 edition "The New Skiing Mechanics," John Howe states "There is only one true continuous, balanced, carved turn radius for a given side cut radius and velocity." John Howe, The *New Skiing Mechanics*, p. 130 (McIntire Publishing 2d ed. 2001). In other words, the turning radius of a ski is 'built into' the ski through design and construction. Under specific conditions, the skier can only carve one turn radius. The skier is forced to change the conditions (e.g., change his or her speed) or break out of the carve and into a skid if a shorter or longer turn is desired.

This difficulty is exacerbated by the fact that the tip and tail of conventional skis are virtually unloaded before the ski is bent into a turn. It is not until the tip and tail edges have grabbed the snow and bent into an arc that the tip and tail of the ski apply significant pressure. Paradoxically, without this pressure, it is difficult to engage the edge to get the ski to bend in the first place. In order to initiate a subtle, long radius turn, the carving skier should be able to slightly roll the ski into a very gentle edge angle. In reality, current ski designs generally cannot respond to such subtle input because the tip and tail are unable to grab the snow effectively until they are bent into a more severe arc. These limitations generally confine the skier to a narrow range of turn radii, making continuous carve skiing problematic.

An alpine ski generally must have a running surface with edges to slide over and/or engage the snow, and sufficient longitudinal spring force to allow the ski to bend into an arc when angled, and then straighten out when placed flat. Historically, these two functions have been performed by a single component: a runner that acts as a long leaf spring and that has a polyethylene base to slide on the snow and steel edges to engage hardpack and ice. An alpine ski is thus basically a continuous leaf spring with a boot attached near the middle and the fore and aft extremities (tip and tail) cantilevered over the snow.

A conventional alpine ski has no preload forces on the tip and tail of the ski. (While the slight camber or arc designed into all conventional skis does create a very slight pressure at the tip and tail, it is negligible for purposes of steering the ski at shallow edge angles.) Thus, with the ski flat on a groomed snow surface, virtually all the weight of the skier is being applied to the snow directly under the skier's boot, with almost no pressure applied to the snow at the tip and tail of the ski. Unfortunately, it is the tip and tail of the ski that create stability and the most significant turning forces. This is a main reason why a conventional shaped ski tends to be unstable until it is edged to a significant angle, i.e., the characteristic turning arc of that ski. Additionally, the small area of high pressure under the boot causes the flat ski to go slower by penetrating the snow surface to a greater extent, which is undesirable for a ski racer.

Because conventional skis lack any significant preload in the straight or unbent condition, such skis are generally designed and constructed to function as a very high spring rate (very stiff) leaf spring. This high spring rate allows the tip and tail to build up significant pressure rapidly as the ski begins to bend, thus providing the required stability along the entire length of the ski at the characteristic turning radius. Unfortunately the high spring rate can also preclude any great variety of turning radii. Once the skier has used his weight to bend the ski into an arc against the high spring rate, the additional bending necessary to create a significantly tighter turning radius may not be possible for lighter skiers.

The high spring rate also tends to make the ski stiff and unforgiving over terrain that is not perfectly smooth, which can throw a recreational skier off balance.

SUMMARY

The invention features skis that have dynamic characteristics that are dramatically different from those of the conventional "shaped" skis described above. Generally, the skis described herein have a very wide range of turning radii with a negligible zone of instability. As a result, the skier or glider can increase or decrease the turning radius at will and effortlessly make a smooth transition from a right turn to a left turn. In some implementations, this is accomplished by providing the skis with a significant preload force and a relatively low spring rate. With the ski flat on the snow, the preload already applies a significant portion of the weight of the skier to the tip and tail of the ski. As a result, as the skier eases into a subtle edge angle, the tip and tail can immediately engage the snow with stability. The skis do not have to be bent up to a threshold arc to turn, and thus the skier can generally steer from wide left turns to wide right turns smoothly with ease. The preload forces also provide significantly greater fore and aft stability for the recreational skier. Additionally, this preload also makes a racing ski faster when flat.

The relatively low spring rate of the ski works together with the preload to create a broad, responsive range of turn radii. As the skier steers into a tighter turn, the additional pressure created by centrifugal force is no longer insignificant, since it is not overcome by the spring rate of the ski. Thus, the pressure generated by centrifugal force can be used to bend the ski into a more severe arc and thus a tighter turn.

The low spring rate also makes the ski more supple and less reactive to surface irregularities. This creates a smoother ride, absorbing forces that would normally be disconcerting to the recreational skier.

In one aspect, the invention features a ski including (a) a ski body having a first end and a second end, the first and second ends terminating, respectively, at a tip and tail at opposite ends of the ski body; and (b) a suspension system connected to the ski body so as to apply a vertical downward force to the first and second ends of the ski body. The suspension system may apply the force before and/or during flexure of the ski.

The suspension system may be configured so that the downward force of the skiers weight is applied to three or more distinct points along the length of the ski body. For example, at least one of the points of applied downward force may be located directly under a boot mounting position, at least one other point may be located between the boot mounting position and the tip of the ski body, and at least one other point may be located between the boot mounting position and the tail of the ski body. The suspension system may be configured so that at least one of the points of applied downward force is located in a front longitudinal third of the ski body, at least one other point is located in a center longitudinal third of the ski body, and at least one other point is located in a rear longitudinal third of the ski body.

In some cases, the suspension system can be configured to provide the ski with a spring rate that diminishes as the ski is flexed from a normal unloaded state or a predetermined state of deflection (as defined below with reference to FIG. 3A) to a state of greater deflection.

For example, the suspension system may be configured so that at a predetermined degree of deflection the spring rate exhibited by the ski will be at least 10% less than a maximum spring rate exhibited by the ski at lesser degrees of deflection.

In some implementations, the suspension system is connected to the ski body by a mounting/linkage system, the mounting/linkage system being configured so that when the ski body is flexed beyond a predetermined degree of deflection the load applied to the ski body by the suspension system decreases or exhibits a decreasing spring rate.

The suspension system may include a spring, e.g., a pneumatic spring or pneumatic shock. The spring may be selected from the group consisting of coil springs, torsion springs, torsion bars, leaf springs, and elastomers.

The suspension system may include a linkage between the first end of the ski body and the second end of the ski body that enables positive deflection of the first end of the ski body to increase the spring force at the second end of the ski body and positive deflection of the second end of the ski body to increase the spring force at the first end of the ski body.

The suspension system may also include a support structure that is attached to a longitudinally central area of the ski, and a mounting system that attaches the support structure to the ski in a manner that substantially precludes yaw and roll movement between the support structure and the ski body. The mounting system may include elements configured to allow elastic movement between the support structure and the ski body in the vertical and longitudinal directions as well as around the pitch axis. The support structure may carry a boot binding. If the suspension structure includes a spring, the spring may be located directly below the boot binding and connected to the first and second ends of the ski body by a linkage system. The support structure may be releasably attached to the ski body. The suspension system may include a spring-like compressible element, e.g., a leaf spring, attached between the support structure and a front and/or rear longitudinal third of the ski body.

The suspension system may be configured to have any one or more of the following characteristics. To cause the ski body to deflect 0.25 inch, it is necessary to apply a force of 20 pounds or greater. The force required for a 1.0 inch deflection is less than three times the force required for a 0.25 inch deflection. The spring rate exhibited during the first 0.25 inch of deflection of the ski body is at least 110% of the spring rate exhibited during the next 0.25 inch of deflection. The additional force which must be applied to deflect the ski body from 0.25 inches deflection to 0.50 inches deflection is at least 10% less than the force which must be applied to deflect the ski body from 0.0 inches deflection to 0.25 inches deflection. The force required for a 0.40 inch deflection is at least 10% greater than the additional force required for a 0.80 inch deflection.

The suspension system may be configured to allow a minimal initial deflection before a predetermined state of deflection at which point further significant deflection is precluded until the force applied by the skier exceeds a predetermined amount. In this case, the ski may include an adjustment mechanism configured to allow the predetermined degree of deflection at which the suspension applies a downward force to the first and second ends of the ski body to be adjustable. The adjustment mechanism may be configured to allow the downward force applied to the ski to be turned on and off. The suspension system may also be configured so that the downward force is not applied to the ski body by the suspension system until the ski body is flexed to a predetermined degree of deflection.

In another aspect, the invention features a ski including a ski body having a first end and a second end, the first and second ends terminating, respectively, at a tip and tail, the ski body having a free camber of 1.5 inches or more, the free camber creating a preload at the tip and the tail when the ski body is deflected to a longitudinally collinear state.

The ski may further include a suspension system, attached to the ski body, the suspension system being configured to restrain the camber of the ski body to create an additional preload. The suspension system may include a support structure that is attached to a longitudinally central area of the ski by a mounting system that substantially precludes yaw and roll movement between the support structure and the ski body. The mounting system may include elements that enable elastic movement between the support structure and the ski body in the vertical and longitudinal directions as well as around the pitch axis. The support structure may carry a boot binding. The ski may further include an adjustment device to allow the degree to which the camber is restrained to be adjusted.

In another aspect, the invention features a ski including (a) a ski body having a front and a back, the front and back terminating, respectively, at a tip and tail at opposite ends of the ski body; and (b) a suspension system connected to the ski body so as to apply a load to the front and back of the ski body, the suspension system being configured to contribute at least 20% to the resistive force that must be overcome in order to deflect the ski body from zero deflection to 0.25 inch deflection, the remaining resistive force that must be overcome being contributed by the ski body.

In another aspect, the invention features a ski including (a) a ski body having a front and a back, the front and back terminating, respectively, at a tip and tail at opposite ends of the ski body; and (b) a suspension system connected to the ski body so as to apply a load to the front and back of the ski body, the suspension system being configured to contribute at least 20% to the resistive force that t must overcome in order to deflect the ski body from the flat, totally linear state to a state of positive deflection, the remaining resistive force that must overcome being contributed by the ski body.

In a further aspect, the invention features a ski including (a) a ski body having a front and a back, the front and back terminating, respectively, at a tip and tail at opposite ends of the ski body; and (b) a suspension system connected to the ski body so as to apply a load to the front and back of the ski body, the suspension system being configured so that the additional force which must be applied to deflect the ski body from 0.25 inches deflection to 0.50 inches deflection is at least 10% less than the force which must be applied by the skier to deflect the ski body from 0.0 inches deflection to 0.25 inches deflection.

Some implementations may include one or more of the following features. The suspension system may be connected to the ski body by a mounting/linkage system, the mounting/linkage system being configured so that when the ski body is flexed beyond a predetermined degree of deflection the load applied to the ski body by the suspension system decreases or exhibits a decreasing spring rate. The suspension structure may be configured to apply a preload to the ski body when the ski is in the normal unloaded state, i.e., a state in which any significant deflection is precluded until the force applied to the ski body exceeds a predetermined amount, as will be discussed below with reference to FIG. 3A.

All parameters in the claims are measured as discussed below with reference to FIG. 3A.

The details of one or more implementations are set forth in the accompanying drawings and the description below. Other features and advantages of the will be apparent from the description and drawings, and from the claims.

DESCRIPTION OF DRAWINGS

Like reference symbols in the various drawings indicate like elements.

DETAILED DESCRIPTION

Figure 1:
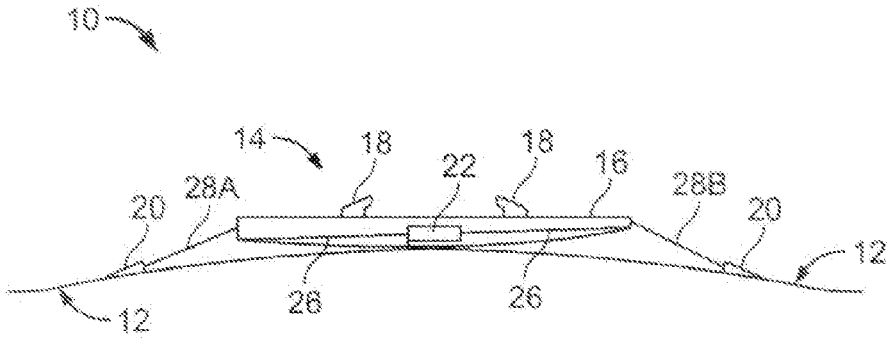
FIG. 1 is a side view of a ski according to one implementation of the invention.

Referring to FIG. 1, ski 10 includes a ski body 12 that functions as a 'runner' or 'glider.' Ski body 12 includes a slippery running surface and edges for engaging the snow/ice. However, unlike the conventional alpine ski construction discussed above, ski body 12 does not primarily determine the spring rate of the ski. As a result, the design of the ski body, including shape, size, and materials, can be optimized for sliding over and/or engaging snow and ice, without needing to significantly compromise these performance characteristics in order to obtain a desired spring rate.

Ski 10 further includes a suspension system 14, described in detail below. The suspension system 14 is designed and constructed to optimize the spring rate of the ski, without spring rate being compromised in order to optimize the gliding/carving function or other characteristics of the ski.

It is this separation of the gliding/carving function and the spring function of the ski into two separate dedicated components (the ski body 12 and the suspension system 14) that facilitates the preload and low spring rate described above.

Figure 3:
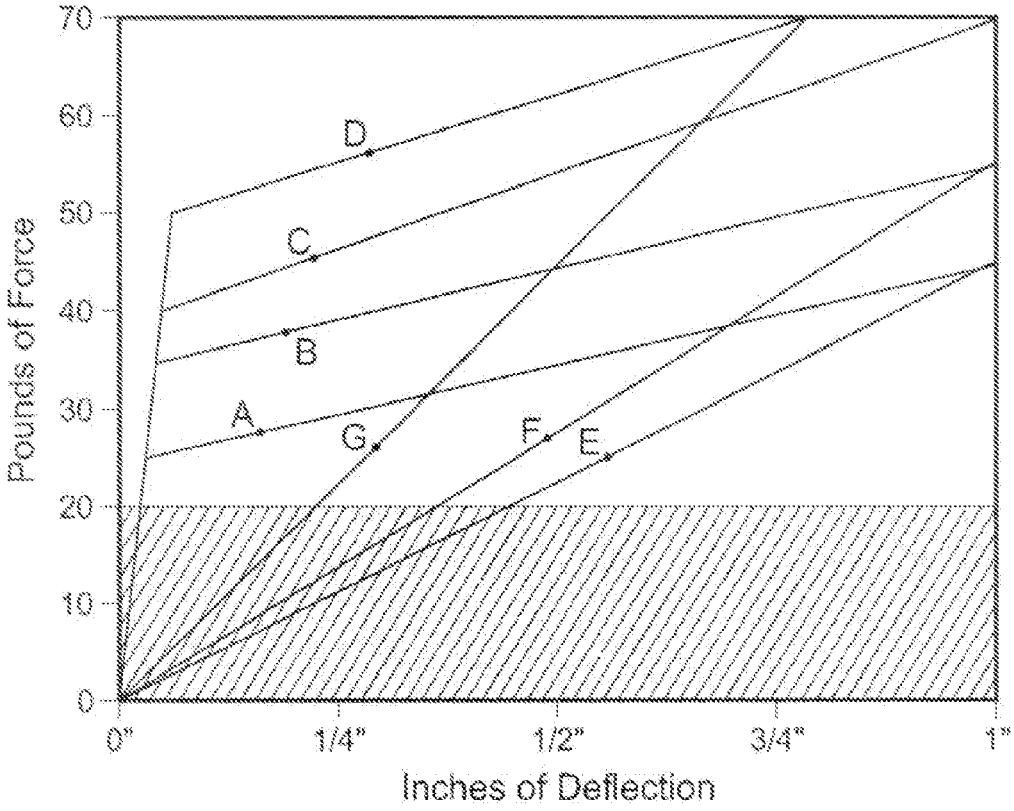
FIG. 3 is a graph illustrating bending deflection (in inches) as a function of force (in pounds) applied to the ski shown in FIGS. 1-2A, and, for comparison, to skis that are not preloaded.
Figure 3A:
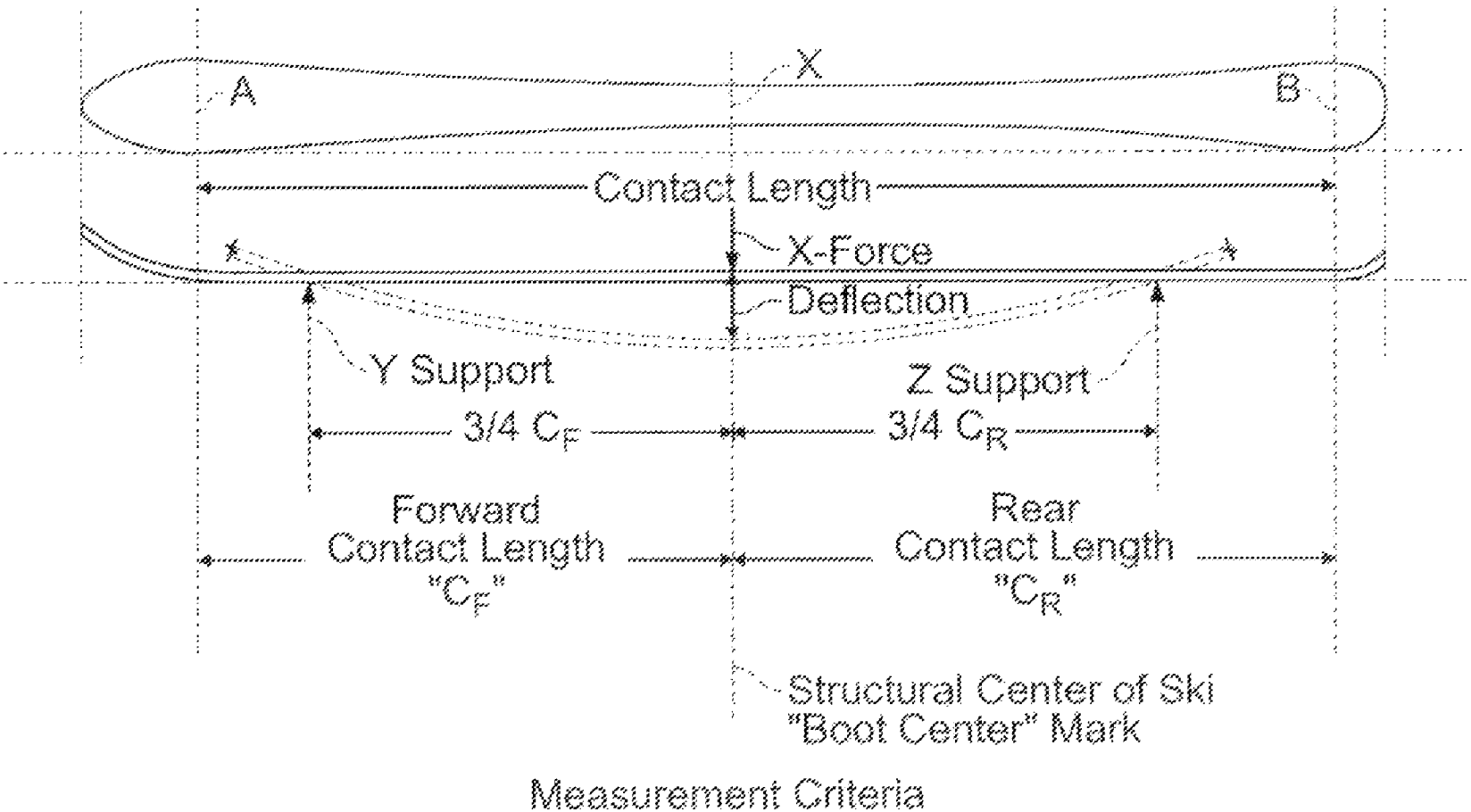
FIG. 3A is a graphic illustration of the measurement methodology and nomenclature used herein.

FIG. 3A illustrates the method used to measure the spring rates and preload. Points A and B denote the points along the long axis of the ski at which the ski has its maximum width at the front and back of the ski respectively. These points typically coincide with the points at which the ski curls upward when its base is held against a flat surface. The distance between these points is the contact length of the ski, i.e., that portion of the ski that actually engages a hard snow surface. This distance is bifurcated at point X, the structural center of the ski, which is also denoted by the "boot center mark." The distances between X and A and between X and B are labeled "Forward contact length: $C_F$" and "Rear contact length $C_R$," respectively. During all measurements, the ski is supported at points Y and Z only, where point Y is ¾ of the distance $C_F$ forward of point X and point Z is ¾ of the distance $C_R$ behind point X.

With the ski supported at points Y and Z, a downward force is applied at point X, which will result in the center of the ski bending downward between points Y and Z as shown in FIG. 3A. For a given force applied at X in this manner, the resulting downward displacement of point X from the initial position, with no force applied, to the position with the force applied, is referred to herein as deflection.

Figure 2:
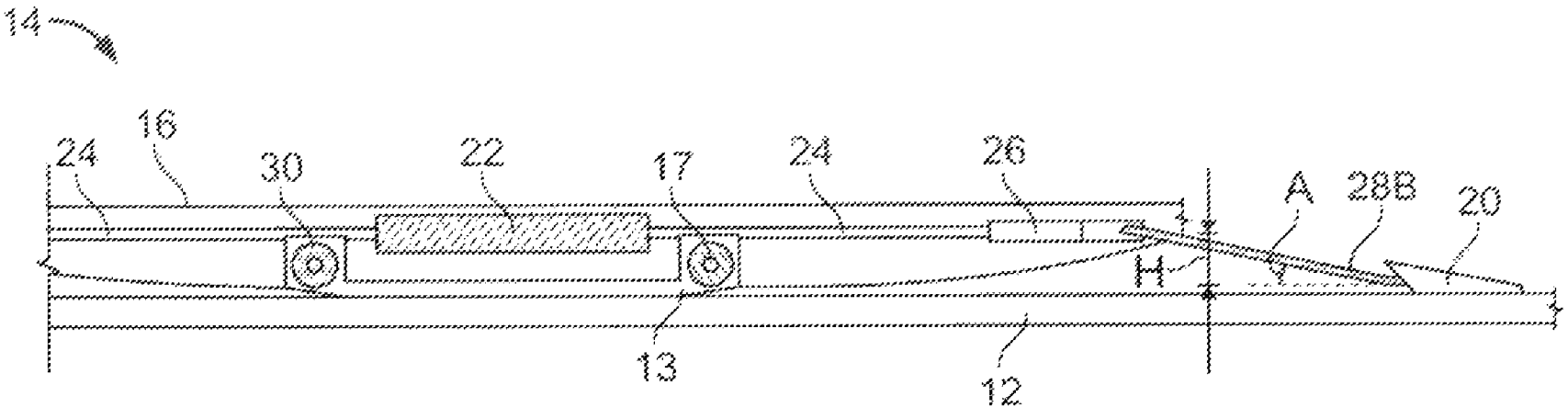
FIG. 2 is an enlarged side view of the right-hand two-thirds of FIG. 1 with the binding omitted.
Figure 2A:
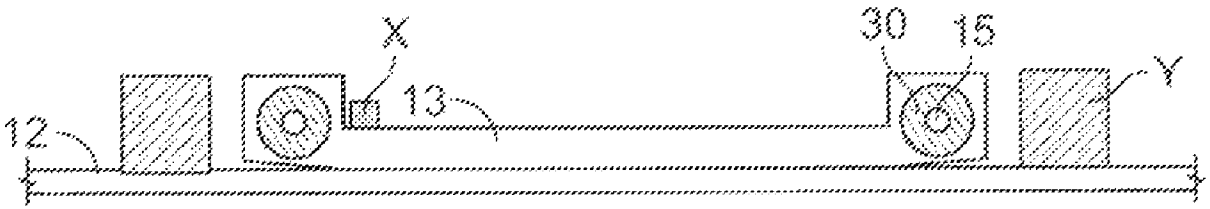
FIG. 2A is a side detail of a portion of FIG. 2.

FIG. 3 graphically illustrates the unique performance characteristics of the ski shown in FIGS. 1-2A relative to skis that are not preloaded. The novel preload feature of the ski shown in FIGS. 1-2A maintains a minimum predetermined pressure on the tip and tail of the ski before significant bending and deflection begins (far left, Plots A-D). When deflection (and turning) begins, the tip and tail are already pressured sufficiently to carve a stable turn. Conversely, the graphs of skis that are not preloaded (Plots E-G) depict a straight and virtually linear relationship between deflection and force, with no significant pressure on the tip and tail prior to bending/deflection. Thus, such skis must experience significant deflection before the tip and tail receive significant pressure.

The shaded portion of FIG. 3 (below 20 pounds pressure) represents the area where a ski will be relatively unstable due to insufficient loading of the tip and tail. The preload feature of the ski shown in FIGS. 1-2A ensures that the ski operates above and outside this area of potential instability. Conversely, the un-preloaded skis (Plots E-G) must always pass through this area before the ski becomes sufficiently loaded to carve a stable turn. This is why it can be so difficult to smoothly transition from a turn in one direction to one in the opposite direction with such skis. The ski shown in FIGS. 1-2A easily steers from left to right without having to circumvent a significant zone of instability. As a result, a carving skier can steer himself to create almost any trajectory or path in a manner similar to an inline skater or bicyclist.

Because the preload pressure immediately brings the ski into the desirable operating zone, the spring rate thereafter is significantly less than a ski without a preload. Measuring as previously described, the skis depicted in Plots E-G have spring rates typically in the range of 45 lbs./inch up to 90 lbs./inch as indicated in FIG. 3 by plots E and G respectively. A spring rate of 55 lbs./inch (Plot F) is exhibited by many conventional recreational skis. The ski shown in FIGS. 1-2A will typically exhibit from 20 lbs. to 60 lbs. of preload before significant deflection and turning begins (A=25 lbs., B=35 lbs., C=40 lbs., D=50 lbs.), and thereafter a spring rate of from 20 lbs./inch to 45 lbs./inch, which is about half the spring rate range of the skis shown in Plots E-G It is this reduced spring rate after deflection begins that provides the supple ride and the enhanced steering response of the skis shown in FIGS. 1-2A.

Figure 5:
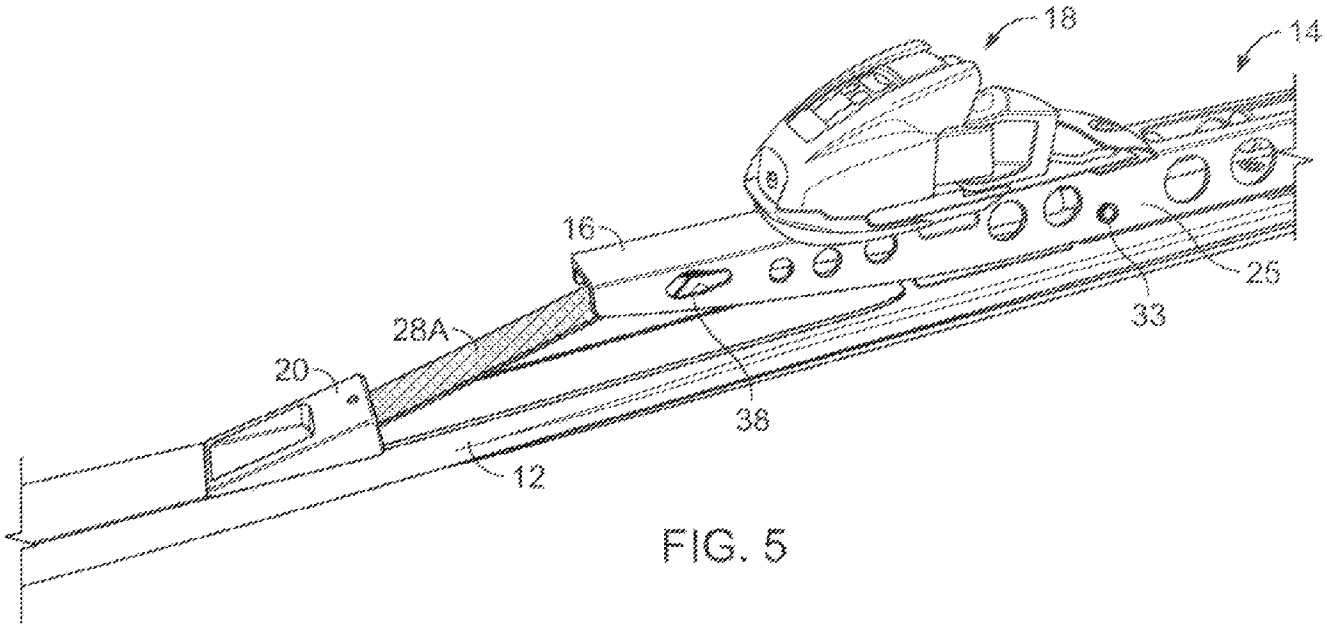
FIG. 5 is a perspective view of a front portion of the ski of FIG. 1.
Figure 5A:
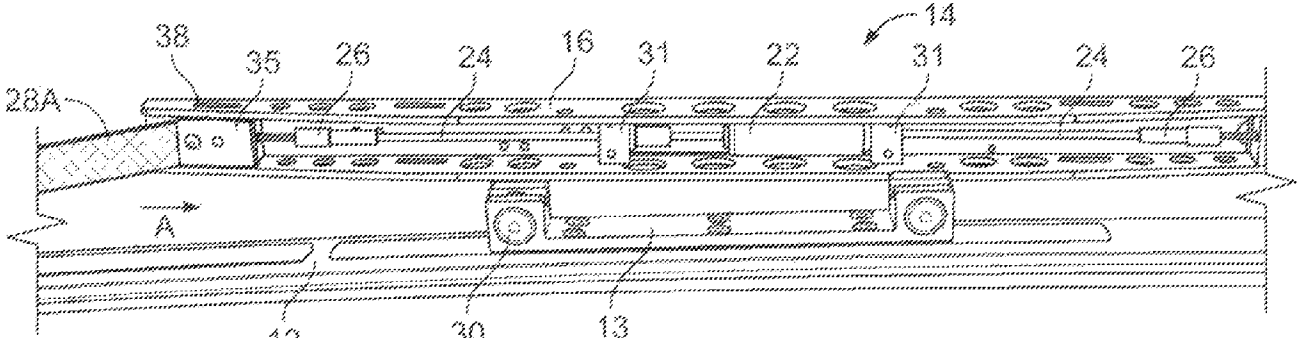
FIG. 5A is a partially exploded view, showing the beam/suspension/support assembly removed from the ski body.
Figure 5B:
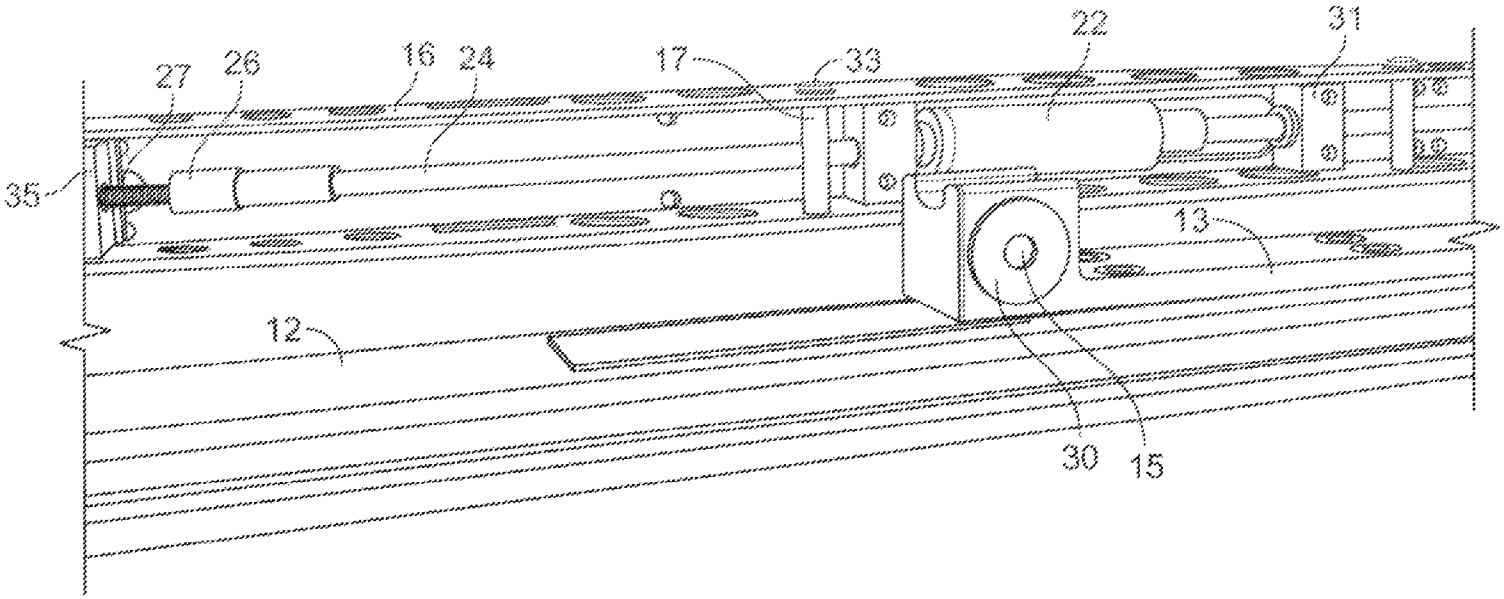
FIG. 5B is an enlarged view of a portion of FIG. 5A.

Referring to FIGS. 2 and 5A-5B, the suspension system 14 may be housed in a substantially rigid support structure 16. Support structure 16 is preferably a beam that is generally U-shaped in cross-section, as shown. The support structure 16 may be formed from aluminum, and may include a plurality of holes or cutouts formed therein to reduce the weight of the beam. In addition to supporting the suspension system 14, the support structure 16 also supports the binding system 18 (FIGS. 1 and 5), to which the boot attaches. The support structure 16 is connected to the ski body 12 by a mounting system that includes two resilient couplings 30 which may be formed, e.g., of an elastomer, and a mounting bracket 13. Couplings 30, in conjunction with the mounting bracket 13, allow movement of the support structure 16 in two of three directions, but do not allow any significant relative yaw or roll between the support structure 16 and the ski body 12. The support structure 16 is attached to the mounting bracket 13 by pins 17 (FIG. 5B) that extend through a bore 15 (FIGS. 2A and 5B) in the resilient coupling 30, which is held in bracket 13, which is in turn attached to or integral with the ski body 12. The pins 17 are internally threaded, and support structure 16 is screwed firmly to the pins 17 by screws 33 (FIGS. 5 and 5B) which are threaded into the pins 17 at each end (the screws are only visible on one side in FIGS. 5 and 5B). The length of each pin 17 corresponds substantially exactly (typically within ±0.005) to the outside width of the support structure 16, and thus each end of the pin is flush with the corresponding outer side wall 25 of the support structure 16. When the screws 33 are tightened down against the outer side walls 25, the engagement of the screw head with the side wall on each side of the support structure 16 contributes to the structural integrity of the support structure 16, preventing the side walls from being spread apart by forces encountered during skiing.

Referring to FIG. 2A, additional elastomer blocks X and Y may be optionally used for applications requiring greater resilient support for large downward compressive forces. The shaft support blocks 31 (FIGS. 5A and 5B) are supported by elastomer blocks X, which thus share the downward compressive forces of the beam 16 with the resilient couplings 30. Elastomer block Y, which fits between the ski body 12 and the beam 16, with clearance for shafts 24, is compressed as the runner 12 deflects into an arc. When compressed in this manner, elastomer blocks Y transmit downward forces from the beam 16 directly to the ski body 12. Because the elastomer blocks Y are located further from the longitudinal center of the ski body 12 than any part of mounting bracket 13, they impart additional pitch stability to the beam 16 and move the effective cantilevered hinge points of the ski body 12 further from the longitudinal center of the ski, which creates greater overall stability under extreme loading.

This pinned attachment of the support structure 16 to resilient couplings 30 also allows the support structure 16 to be easily removed, allowing the assembly of the support structure 16 and suspension system 14 to be removed and replaced by the user of the ski 12. This removability allows the user to interchange suspension systems having different performance characteristics, and also allows the user to remove the support structure/suspension system assembly to facilitate transport and storage of the ski and/or to prevent theft of the assembly. If desired, the screws 33 may be replaced by locking fasteners for which the ski owner has the key, reducing the likelihood of theft when the ski owner chooses not to remove the assembly from the ski body at a ski area or other public place.

The support structure 16 maintains a close side-to-side tolerance with the bracket 13, which precludes any yaw and roll motion between the two parts. On the other hand, the resilient couplings 30 allow the pins 17, and thus the support structure 16, some damped movement up/down and fore/aft. This resilient suspension of the support structure 16 over the ski body 12 helps isolate the user of the ski from shocks and vibration. This movement also allows a slight rotation of the support structure 16 about the pitch axis relative to the ski body 12 when a skier becomes fore/aft imbalanced, which in turn alters the geometry of the suspension to create a greater down force on that portion of the ski body that would otherwise become light and unstable.

Figure 6:
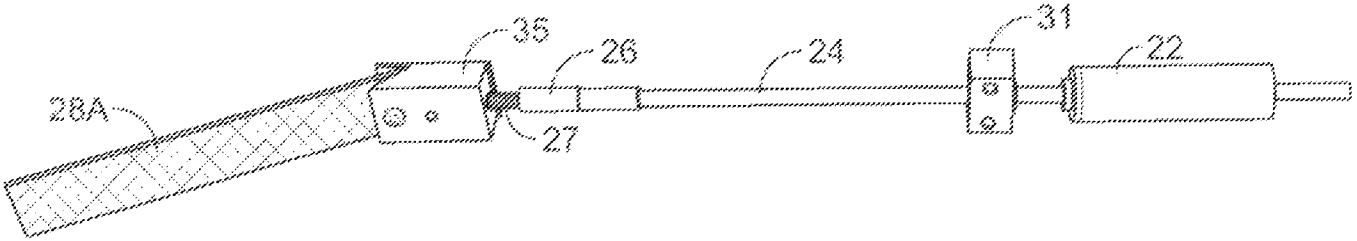
FIG. 6 is a perspective view of the rear half of the suspension sub-assembly.

The support structure 16 carries a main spring 22. Main spring 22 is normally in a highly compressed state, typically in the 30 lb to 220 lb range. In the implementation shown in FIGS. 1-2A and 5A-5B, the spring may be, for example, a gas spring having a stroke of approximately 1-1.5 inches and a force ratio of approximately 1:1.4 from initial movement to end of stroke. For reasons of mass centralization and low moment of inertia, the spring 22 is typically located in approximately the center of the ski body 12, directly under the binding system 18. Referring to FIGS. 2, 5A and 6, the spring 22 is connected via shafts 24 and linkage 26 to the fore and aft struts 28A, 28B, which engage the ski body 12 through couplings 20 as will be discussed below. Each of the shafts 24 is supported by one or more support blocks 31 (while one block is shown in FIGS. 5A and 6, in some implementations each shaft 24 is supported by two blocks, one at each end of the shaft) which are firmly mounted on support structure 16. As the front and back of the ski body 12 bend upwards into an arc, the couplings 20 push the struts 28A, 28B inwards into the support structure 16 (see arrow A, FIG. 5A), compressing the main spring 22 through the linkage 26 and shafts 24. This unique spring/suspension system helps provide the dynamic characteristics discussed herein.

Figure 7:
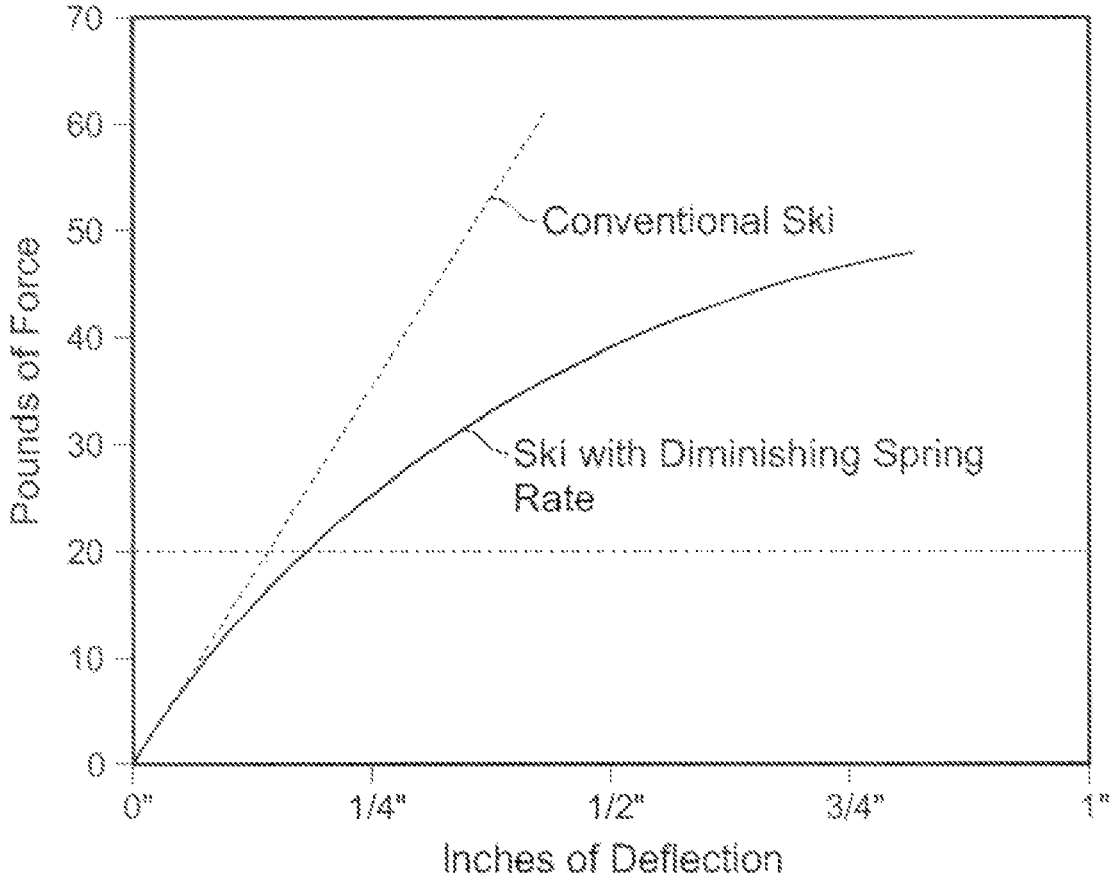
FIGS. 7-9 are graphs illustrating the performance (spring rate) characteristics of various skis.
Figure 8:
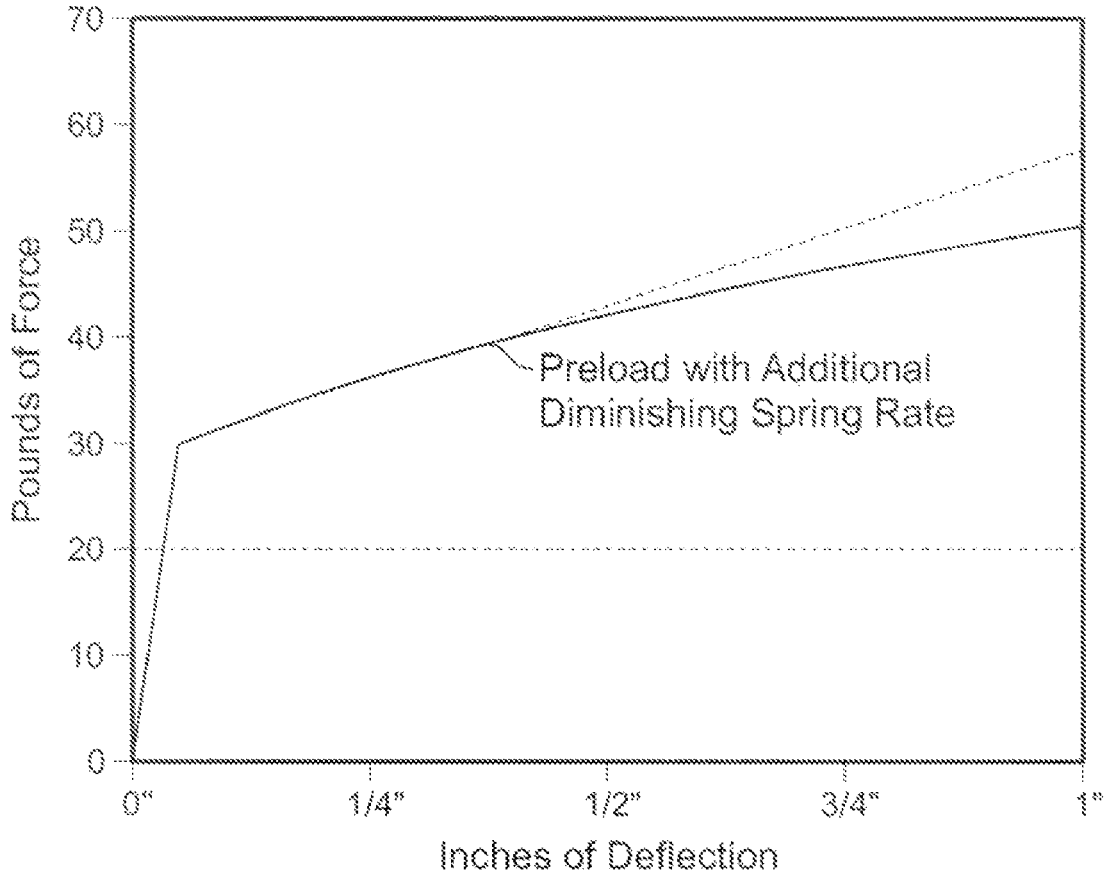

It is noted that the arrangement of struts 28, linkages 26 and shafts 24 relative to the ski body 12 may be configured so that the ski exhibits a diminishing spring rate beyond a certain degree of flexure, as illustrated graphically in FIGS. 7 and 8. When the spring rate diminishes in this manner, the ski will perform more and more like a "soft" ski when the ski body is dramatically flexed. This reduction in spring rate is the result of struts 28, linkages 26 and shafts 24 becoming generally colinear as the ski is flexed. Once these components are colinear, the spring 22 will cease to apply any significant additional force to the tip and tail of the ski upon further flexure. How much the ski must be flexed before this colinearity occurs (if it does at all) can be predetermined by, for example, adjusting the angle A (FIG. 2) between the strut 28 and a line drawn from the base of the strut 28 parallel to the upper surface of the ski body 12, and/or the height H of the point at which the strut 28 is joined to the support structure 16 above this line. To provide good leverage to the skier, it is generally preferred that H be at least 0.25", more preferably at least 0.5", and most preferably at least 1.0". Greater heights can also be effective. Angle A may be, for example, about 3 to 40 degrees, and preferably about 5 to 15 degrees.

The linkage 26 can include adjustable elements that can be used to set the camber of the ski to any desired level. These adjustable elements allow the effective length of shafts 24 to be adjusted, thus pushing the tip and tail up or down via struts 28 and couplings 20, which decreases or increases "free camber" respectively. For example, as shown in FIGS. 5B and 6, the linkage 26 may include a threaded portion 27 that allows the length of shaft 24 to be adjusted by screw adjustment, i.e., by threading the threaded portion 27 of linkage 26 in and out of an internally threaded block 35 secured at one end of the strut 28. Optionally, the threaded block 35 may be retained in its desired position under support structure 16 by pins (not specifically shown) secured into the body of the threaded block 35 that extend into a slot 38 formed in the support structure 16. In this pin an slot arrangement, the threaded block 35 is allowed to move longitudinally with respect to the support structure 16 but cannot become completely disengaged from the support structure 16 until the pins are removed. Under conditions where the terrain may be severely undulated, adjusting the ski to have additional camber allows the ski to bend into an exaggerated concave shape when the tip and/or tail would otherwise have become unloaded. This creates a 'long travel suspension' that will keep the tip and tail of the ski in contact with the snow for better control and stability.

Moreover, referring to FIGS. 1 and 2, in the suspension system 14 the fore strut 28A is connected to the aft strut 28B by the shafts 24, which both terminate at opposite ends of the single main spring 22. This novel independent but linked suspension will automatically equalize the spring load on both fore and aft struts 28A, 28B. Typically with a conventional ski, when the skier encounters a bump, the front of the ski is bent upwards and the skier is thrown backwards to the soft, as yet unbent, tail. The skier literally has to fall backward in order to bend and load the back of the ski to match the front. The linked suspension system described herein responds uniquely to this same situation. Upon encountering a bump, the front of the ski will absorb much of the energy by compressing the suspension spring 22 to a higher pressure. Because of the continuous linkage, this same raised pressure is applied to the tail of the ski. The raised pressure on the tail of the ski helps keep the skier balanced against the backward thrust while also keeping the tip down for continued control and stability.

This linked suspension system creates a unique sense of stability for the recreational skier, absorbing and balancing forces that would normally be upsetting. Moreover, because the entire suspension/binding system assembly is resiliently mounted by couplings 30 (e.g., elastomer couplings) on the ski body (the running surface), vibrations and shocks directly underfoot are also effectively damped.

The ski shown in FIGS. 1-2A and described above facilitates optimizing the various dynamic parameters to achieve maximum stability over the widest range of turn radii. For teaching beginners and other purposes for which a less sophisticated suspension system may be appropriate, ski 100, shown in FIG. 4A, presents a more economical approach.

Figure 4:
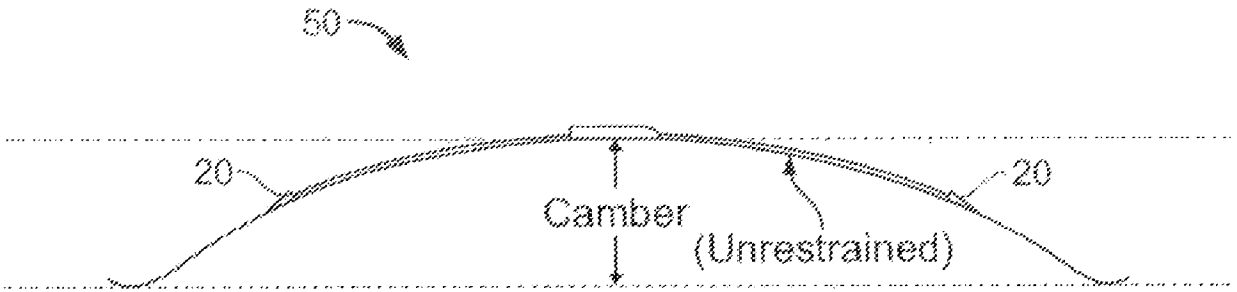
FIGS. 4 and 4A are side views of a ski before and after mounting of the binding/suspension structure onto the ski, respectively.
Figure 4A:
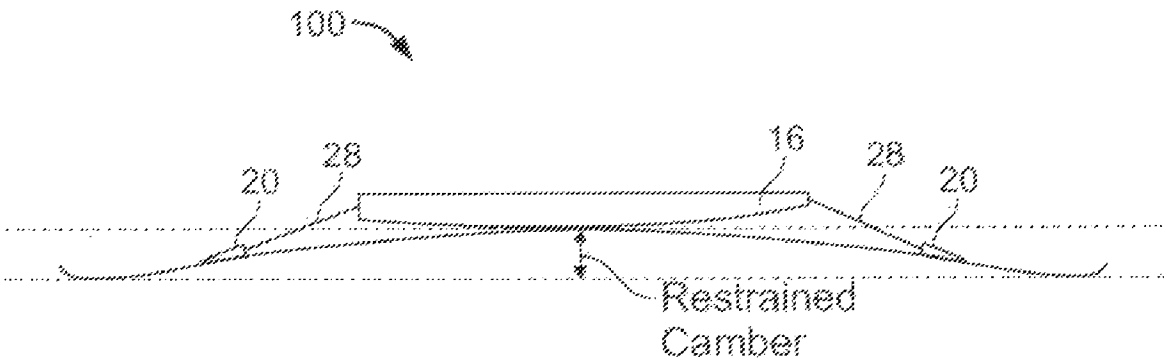

FIG. 4 shows a ski body 50 that is suitable for use as a runner for the ski 100 shown in FIG. 4A, before the spring suspension system and binding system are mounted. Ski body 50 is formed with an exaggerated free camber. The "unrestricted camber" of ski body 50 in FIG. 4 is typically in the range of 1 inch to 5 inches. The very low spring rate of the ski body 50 is also a significant departure from typical ski characteristics. Measured as shown in FIG. 3A and described above, the spring rate of ski body 50 of FIG. 4 would typically be in the range of 20 lbs./inch to 40 lbs./inch but could be in the range of 10 to 20 lbs./inch or 40 to 60 lbs/inch in the extreme cases of small children or heavy athletes respectively. Conventional skis typically fall within the range of 40 lbs./inch to 85 lbs./inch, which is approximately double that of the ski 50 in FIG. 4.

Once again, the support structure 16, carrying the restraining/suspension system 14 and the binding system 18, is coupled to the ski body 50 by bracket 13 and resilient couplings 30 that absorb shock and vibration while providing precise yaw and roll control. For economical reasons, the resilient couplings could be eliminated and a direct attachment used, e.g., screws or bolts.

After the support structure 16 is in place on the ski body 50, the assembly is compressed against a flat surface until almost all the extreme camber has been sprung flat. In this constrained state, a profile view of the ski body would look like a conventional ski at rest, unloaded and uncompressed. While in this confined configuration, the two couplings 20 at the fore and aft of the ski are engaged with corresponding linkages 28 on the suspension structure. Upon removal from the constraining apparatus (FIG. 4A), the ski 100 remains in the relatively un-cambered, stressed state, as the rigid support structure 16, by way of the fore/aft couplings 20, and struts 28, prevents the ski body 50 from returning to the extreme concave camber configuration as shown in FIG. 4. As such, this implementation also exhibits the novel characteristics of the ski shown in FIGS. 1-2A, specifically a significant preload force and a low dynamic spring rate. The graphic load vs. deflection plots of this implementation would be similar to A-D of FIG. 3. This implementation can be manufactured using a relatively simple process. The support structure 16 can be injection molded plastic and the linkage 28, because it is in tension only, can be a simple length of cable.

In addition, length adjustment features can be incorporated into the couplings 20 and/or struts 28, and/or into the support structure 16, that would allow the amount of camber to be easily adjusted. By lengthening or shortening the effective length of the restraining struts 28, the ski body 50 can be allowed to bend more or less in the unloaded state. Thus the static camber can be adjusted over a wide range from that of a conventional ski to an extremely long-travel concave shape.

Moreover, additional components, such as elastomers or springs can be employed in or between couplings 20, struts 28, and support structure 16 to augment or modify the dynamic characteristics. For example, incorporating an elastomer where each strut 28 is joined to either support structure 16 or coupling 20 would damp the suspension 14 upon full extension as in a situation when the skier leaves the snow surface momentarily.

An alternate version of this implementation uses cables as the coupling members that limit the camber and create the preload force (i.e., struts 28 may be replaced by cables). Camber adjusters and spring tensioners can also be used in this system to adjust the camber and preload.

In another implementation, elements of the two previously described implementations can be combined. Thus, the ski 10 shown in FIGS. 1-2A can be modified to include a low spring rate ski body that has extreme concave camber in the unrestrained state. In such a case, the struts and couplings, together with the linkage and support structure, perform the restraining function (tension/unloaded) as well as the preload function (compression/loaded) as described above.

A number of implementations have been described. Nevertheless, it will be understood that various modifications may be made without departing from the spirit and scope of the invention.

For example, the principles discussed above may be utilized to provide skis having a variety of performance characteristics. For instance, as illustrated graphically in FIG. 7, the ski may exhibit a diminishing spring rate without an initial preload. This may be accomplished, e.g., by mounting the suspension system/support structure assembly discussed above with reference to FIGS. 1-2A and 5-5B on a ski body having a very low spring rate (i.e., a very "soft" ski body) and using a spring having a relatively low spring rate (e.g., a coil spring) in the suspension system. Thus, prior to flexing the ski, the coil spring will apply only enough force to the tip and tail to cause the ski to perform like a conventional ski having average stiffness. As discussed above with reference to FIG. 8, as the ski is flexed beyond a certain point the spring will apply less and less additional force to the tip and tail for equal increments of deflection, and thus the ski will perform more and more like a soft ski as it is flexed more and more dramatically.

Figure 9:
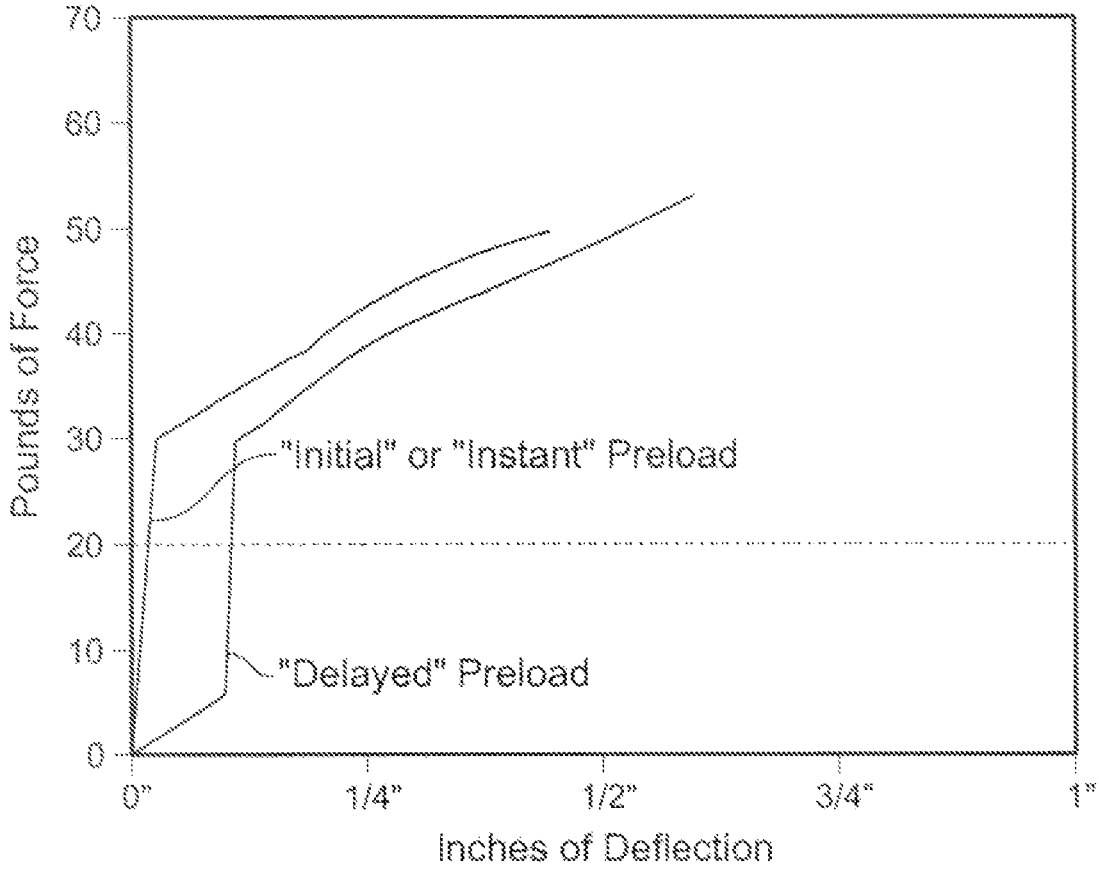

Alternatively, or in addition, a "delayed" preload may be applied to the ski body, as illustrated graphically in FIG. 9. This may be accomplished, for example, by allowing a certain amount of flexure of the ski body before the spring of the suspension system is engaged, e.g., by using a telescoping strut that provides a small (e.g., 0.125") free play before the spring is engaged. The degree of flexure before the spring is engaged can be adjustable by the skier if desired, e.g., by including with the telescoping mechanism a screw, detent or cam adjustment mechanism. This "delayed preload" may be desirable when the ski is to be used under icy conditions, particularly when combined with the features described in the "Glider Skis" and "Ski with Tunnel Edge" patent applications incorporated by reference below. When combined with these features, the delayed preload will allow the skier to keep maximum pressure on the ski edge under the user's foot between turns, enabling the edge to firmly engage the snow/ice surface and give the skier a feeling of stability. The delay may also be adjusted to such an extent that the preload may be delayed indefinitely, i.e., "turned off," when it is not desired. This feature may be useful during specific teaching exercises.

Moreover, the implementations discussed above can be modified to incorporate the following features and/or elements either individually or in combination.

The ski body 12 can be a glider, conforming to the shape and dimensional characteristics taught in U.S. Pat. No. 6,857,653, Feb. 22, 2005 and titled "Glider Skis", the complete disclosure of which is incorporated herein by reference. For example, the ski body 12 could have a very narrow waist, e.g., 40 mm or less, and the tip and tail could be significantly wider, e.g., the ratio of the maximum tip and tail width to the waist width may be 2:x where $0.5 \leqq x \leqq 1.5$, as described in the above-referenced patent application. This ski body geometry would generally enhance the steering characteristics of the ski.

The ski body 12 may include a "tunnel edge" structure such as those described in U.S. Ser. No. 10/603,248, filed Jun. 25, 2003 and titled "Ski with Tunnel and Enhanced Edges," now issued as U.S. Pat. No. 7,073,810., the complete disclosure of which is incorporated herein by reference. Such skis have a ski edge geometry and carving performance similar to that of an ice skate. One or more recesses or channels are introduced in the bottom running surface of the ski to expose the inner side of the ski edges. The channels run alongside the steel side edges of the ski. The running surface includes flat sections for preventing both edges from digging in at once and stopping a skier's forward movement. The presence of the channel exposes an inner side of the ski edge, so that during a turn, the ski edge acts like a skate blade and produces a dig angle with the snow surface, compared to a skid angle produced by the plane of the running surface between the ski edges. This edge structure would enhance control under hardpack or icy conditions, particularly in combination with the "delayed preload" feature discussed above with reference to FIG. 9.

Figure 14:
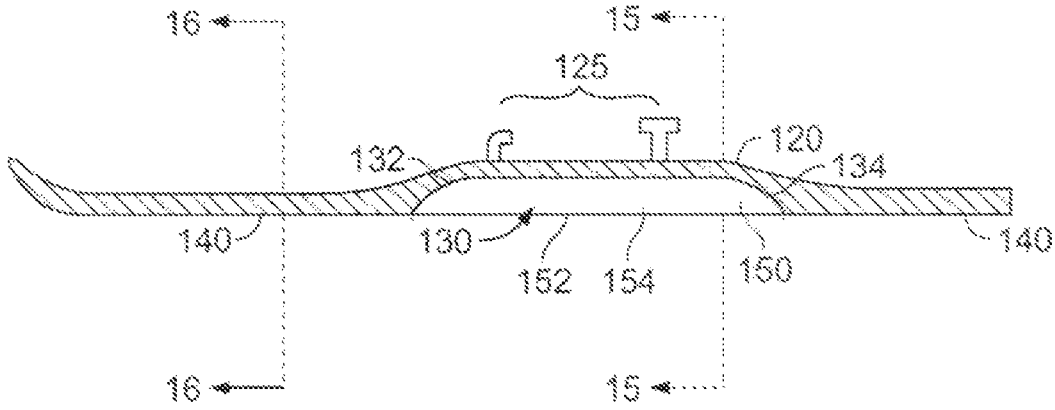
FIG. 14 is a sectional side elevation view of a ski viewed from the longitudinal centerline of the ski, with the suspension system omitted.
Figure 15:
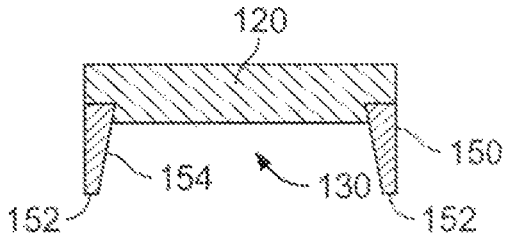
FIG. 15 is an end sectional view of the ski of FIG. 14 taken along line 15-15.

Examples of tunnel edged skis are shown in FIGS. 14-18C. FIG. 14 shows a ski 120 having a hollow or channel 130 formed in the running surface 140 beneath the area of the boot binding 125. The channel 130 has sloped front and rear ends 132, 134 which preferably gradually join the deepest part or ceiling of the channel 130 with the running surface 140. As shown in FIG. 15, the sides of the channel 130 are closed by ski edges 150, which are preferably made of steel and typically extend along the entire length of ski 120 except at the extreme tip and tail, but may be shorter or longer. The ski edges 150 adjacent the channel 130 are exposed on two or three sides, rather than just one or two, so that the inner side 154 is available to contact the snow. The bottom surface of the ski 120 adjacent the edges is recessed and does not contact the snow in hardpack or icy conditions. All of the downward force of the skier is supported only by the edge 150 in the area of the channel 30. As a result, the ski edges 150 at the channel 130 function similarly to ice skate blades during a turn because they are exposed on both the outer side and inner side 154, without additional surface to impede penetration. The skier's force in a turn is applied to the skiing surface through edge tip 152 and inner side 154, rather than through a corner of the edge 150 and running surface 140. The exposed inner ski edge 154 effectively turns the forces applied by the skier to the skiing surface by 90° so that the ski edge 150 is positively engaged with the skiing surface at a dig angle of some degree.

Figure 16:
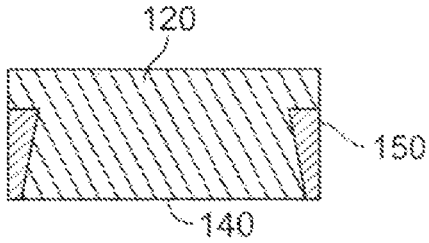
FIG. 16 is an end sectional view of the ski of FIG. 14 taken along line 16-16.

FIG. 16 shows the solid ski body 120 at the front end ahead of channel 130. At this location, ski edges 150 are exposed only on the outside and edge tip 152. Inner side 154 is mounted directly against ski body 120 and covered. As illustrated in FIG. 14, the channel 130 preferably extends through approximately the center third of the length of the ski 120, while running surfaces 140 of the front and rear thirds remain flat and smooth, and without channels. However, in alternate implementations channel(s) may run from 5% to 100% of the length depending on the terrain surface and intended application.

Figure 17:
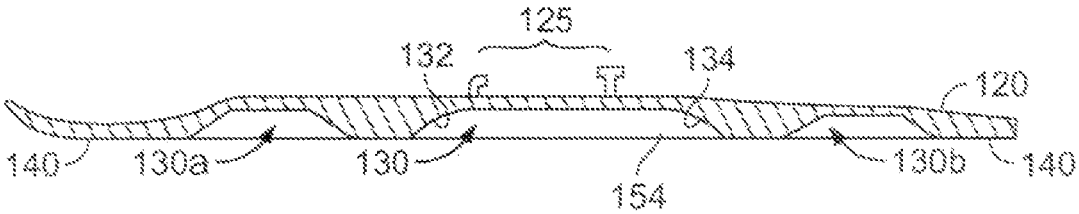
FIG. 17 is a sectional side elevation view of a ski viewed from the longitudinal centerline of the ski, again with the suspension system omitted.

As shown by FIG. 17, the channel 130 may be discontinuous, with discrete channels 130 formed in two or more areas along the length of the ski 120. For example, a second channel 130*a* can be formed near the front end or tip of the ski 120, and a third channel 130*b* formed near the rear or tail of the ski 120.

The channels 130*a*, 130*b* may have the same or a different shape as the channel 130 under the boot binding area of the ski 120. In each case, the front and rear ends of the channels 130, 130*a*, 130*b* are sloped from the channel ceiling to the running surface 140. The channel ceiling is preferably flat.

Figure 18A:
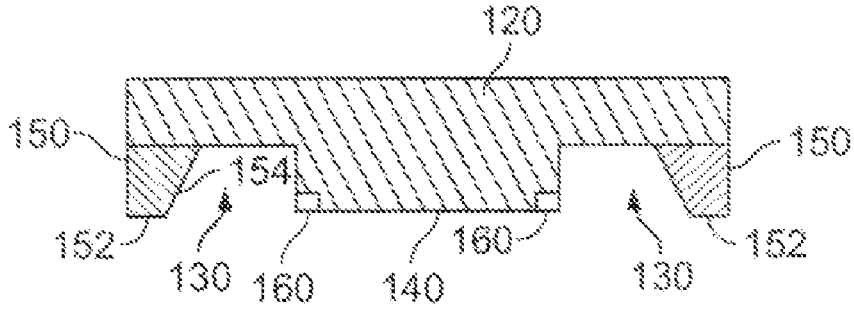
FIGS. 18A-18C are end sectional views of skis having various channel shapes.
Figure 18B:
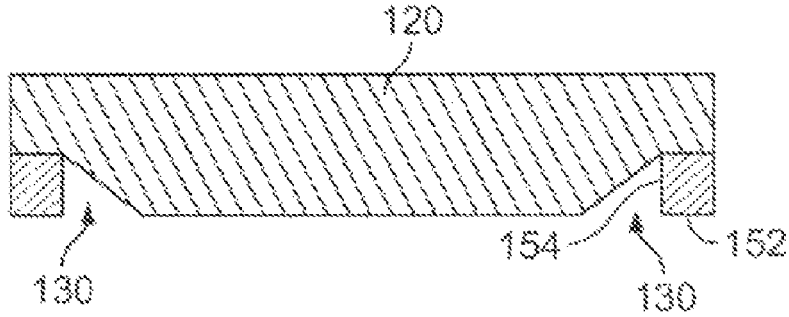
Figure 18C:
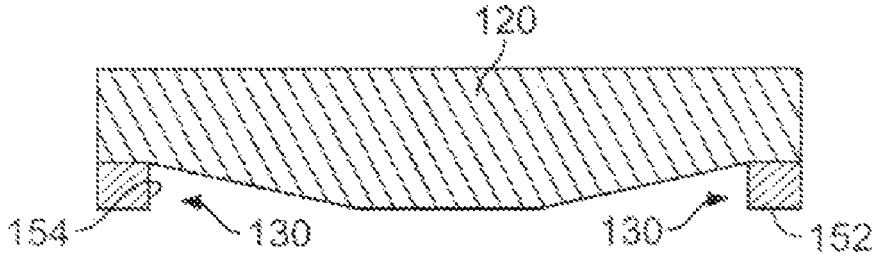

FIGS. 18A-18C show implementations in which the channel 130 is divided into two separate channels 130 in the running surface 140 on either side of the ski 120. The ski edges 150 each have exposed inner side 154 facing one of the channels 130 for contacting the snow surface. The running surface 140 is preferably flat, and may have second edges 160, as illustrated in FIG. 18A.

The coupling of the ski body 12 and support structure 16 and suspension system 14 can incorporate a quick release means, allowing the ski body 12 and suspension system 14 to be easily and rapidly disengaged. This would allow a skier to travel with one pair of suspension/boot binding structures together with several pair of ski bodies, each optimized for different conditions.

The main spring 22 can incorporate a quick-change feature, allowing it to be easily exchanged for an alternate main spring with a different preload and/or spring rate.

The struts 28A, 28B (FIG. 1), which are normally in a state of substantially pure tension or pure compression, can be configured with a rotational moment that can apply an upward or downward force to the ski body 12 in addition to the tension/compression forces. This can be achieved through springs, torsion bars, and/or elastomers. Moreover, greater or lesser preloads and spring rates may be used.

Figure 10:
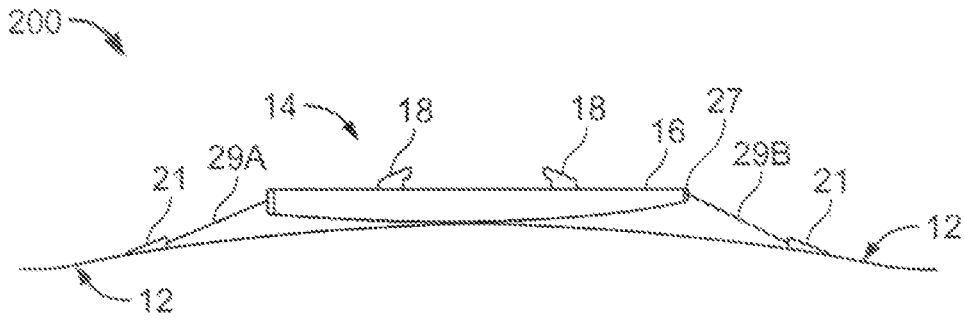
FIG. 10 is a side view of a ski that employs dual leaf springs.
Figure 11:
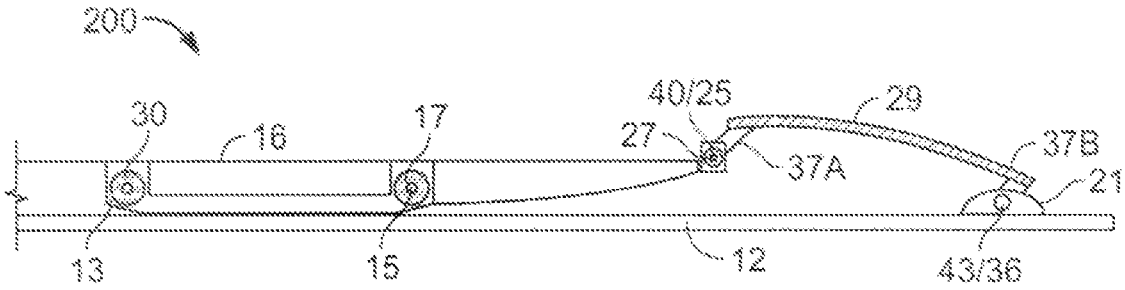
FIG. 11 is an enlarged view of a portion of FIG. 10.

Another implementation is shown in FIGS. 10 and 11. Similar to the previously described implementations, ski 200 is comprised of a ski body or runner 12 with an attached mounting bracket 13, a support structure 16 secured to bracket 13, and leaf spring brackets 21 (FIGS. 2 and 11). Referring to FIGS. 10 and 11, ski 200 is also similar to the previously described implementations in that it comprises a support structure 16, which mounts to the ski body 12 with pins 17 as discussed above.

In lieu of the centrally located main spring and linkages of the previously described implementations, the support structure 16 in this implementation comprises leaf spring mounting brackets 27 that are attached to both ends of the support structure 16, with the method of attachment allowing the location of the brackets 27 to be longitudinally adjustable by a small amount within the ends of the support structure 16 such as by having brackets 27 slide in or out within the support structure 16 after the bracket mounting screws (not shown) have been loosened. Such longitudinal adjustment will increase or decrease the force of the leaf spring upon the ski body 12 at any specific deflection to compensate for differences in the weight of the skier or changes in snow conditions.

Figure 12:
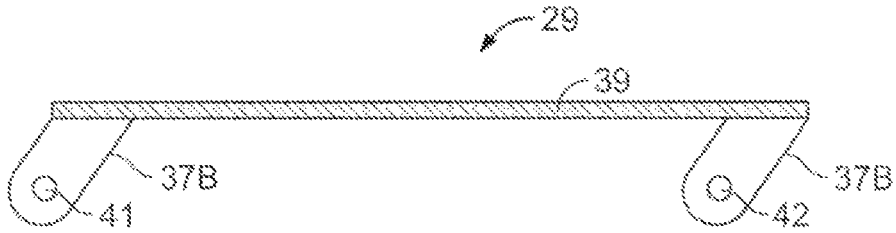
FIG. 12 is a side view of a leaf springs assembly.

FIG. 12 is an enlargement of one of the leaf spring assemblies 29, which includes a resilient component 39 with attached mounting bosses 37A and 37B secured or formed at each end. The resilient component 39 can be a composite of resin and fiber such as epoxy and fiberglass, carbon, or Kevlar, or a spring tempered metal. Each of the leaf spring assemblies 29 is connected at its opposite ends to the support structure 16 and the ski body 12, for example using pins 25 and 36, as shown in the figures. Thus, boss 37A of each leaf spring assembly 29 is connected to the support structure 16 by a pin 25, which passes through both a hole 40 in the leaf spring mounting bracket 27 and a corresponding hole 41 in the boss 37A. The other boss 37B is connected to the ski body 12 by a pin 36 that passes through both a hole 43 in the bracket 21 (FIG. 11) and a corresponding hole 42 in the boss 37B (FIG. 12). The pins 25 and 36 are drilled and tapped at both ends to accept screws that will retain the pins after insertion.

Ski 200 functions with the same performance characteristics and benefits of the previously described implementations because flexing of the ski body 12 into an arc compresses the leaf spring assemblies 29, creating a downward force on the ski body through brackets 21.

Figure 13:
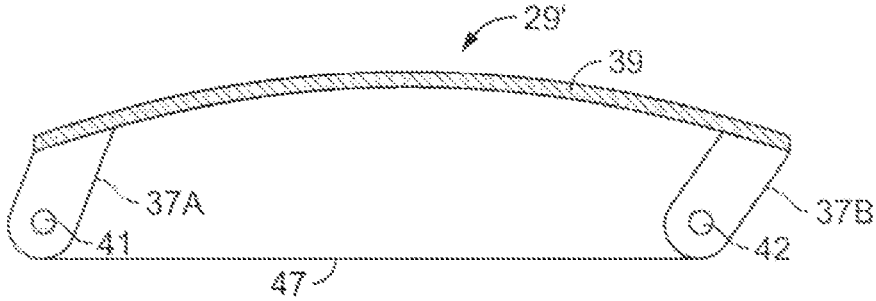
FIG. 13 is a side view of the leaf spring assembly of FIG. 12 with a pretensioner installed.

FIG. 13 is a side view of a leaf spring assembly 29' similar to that shown in FIG. 12, but with a preload tensioner 47 attached. The preload tensioner 47 in this implementation is a stainless steel cable that is attached to the ends of bosses 37A and 37B while the leaf spring is held in a state of compression. The preload tensioner 47 can also be a solid rod attached between the two bosses 37A and 37B in a manner that precludes the bosses from moving apart, but does not restrict the bosses from moving closer as when the leaf spring encounters additional compression. The preload tensioner 47 can also be a rigid structure attached directly to the resilient component 39 while it is in the compressed state such that the resilient component is constrained to the minimum arc created by the compression but is free to arc further upon additional compressive force. When the compressive force is removed, the preload tensioner 47 prevents the bosses 37A and 37B from moving away from each other, keeping the resilient element 39 in a constant state of compression. When the leaf spring element 29' is installed in a ski similar to ski 200 shown in FIGS. 10 and 11, the ski will exhibit the preloaded characteristics previously described. The pretensioned leaf spring assembly 29' will preclude movement of the bracket 21 until the pretension force is exceeded. More importantly, the downward pretensioned force of the leaf spring assembly 29' is transferred to the ski body 12 by the bracket 21 even before the ski body experiences significant deflection. Such pretensioning typically creates a downward force on the ski body at each of the brackets 21 of between 7% and 16% of the skiers weight when the ski body is deflected to a longitudinally collinear shape, as when the ski is horizontal on a flat surface.

Accordingly, other implementations are within the scope of the following claims.

What is claimed is:

1. A ski comprising:

a ski body having a first end and a second end; and a suspension system connected to the ski body so as to apply a vertical downward force to the first and second ends of the ski body, the suspension system comprising a spring applying the vertical downward force to at least one of said ends of the ski body, the spring being under compression when the ski is free of external forces, wherein the suspension system is configured to provide the ski with a spring rate that diminishes as the ski is flexed from a normal unloaded state or a predetermined state of deflection to a state of greater deflection, the suspension system further comprising a second spring applying a second vertical downward force to the other end of the ski body and a support structure that is attached to a longitudinally central area of the ski body, wherein the vertical downward forces applied to the first end and the second end of the ski body are different that one another, and wherein each of the vertical downward forces applied to the first end and the second end are at least partially determined by a fore/aft rotation of the support structure about a pitch axis relative to the ski body.

2. The ski of claim 1 wherein the suspension system is configured so that the downward force of a skier's weight is applied to three or more distinct points along the length of the ski body whenever the ski is in contact with a surface.

3. The ski of claim 2 wherein the first end and second end terminate, respectively, at a tip and tail at opposite ends of the ski body, and the suspension system is configured so that at least one of the points of applied downward force is located directly under a boot mounting position, at least one other point is located between the boot mounting position and the tip of the ski body, and at least one other point is located between the boot mounting position and the tail of the ski body.

4. The ski of claim 2 wherein the ski body defines a running length between the first end and the second end, and the suspension system is configured so that at least one of the points of applied downward force is located in a front longitudinal third of the running length of the ski body, at least one other point is located in a center longitudinal third of the ski body, and at least one other point is located in a rear longitudinal third of the running length of the ski body.

5. The ski of claim 2 wherein the ski body defines a running length between the first end and the second end, and the suspension system is configured so that at least one of the points of applied downward force is located in a front longitudinal quarter of the running length of the ski body.

6. The ski of claim 5 wherein the suspension system is configured so that at least one of the points of applied downward force is located in a front longitudinal sixth of the running length of the ski body, at least one other point is located in a center longitudinal third of the running length of the ski body, and at least one other point is located in a rear longitudinal sixth of the running length of the ski body.

7. The ski of claim 1 wherein the suspension system is configured so that at a predetermined degree of deflection the spring rate exhibited by the ski will be at least 10% less than a maximum spring rate exhibited by the ski at lesser degrees of deflection.

8. The ski of claim 1 wherein the suspension system is connected to the ski body by a mounting system, the mounting system being configured so that when the ski body is flexed beyond a predetermined degree of deflection the load applied to the ski body by the suspension system decreases or exhibits a decreasing spring rate.

9. The ski of claim 1 wherein the spring comprises a pneumatic spring or pneumatic shock.

10. The ski of claim 1 wherein the spring is selected from the group consisting of pneumatic springs, coil springs, torsion springs, leaf springs, bow springs and elastomer springs.

11. The ski of claim 1 wherein the suspension system is configured to allow a minimal initial deflection before a predetermined state of deflection at which point further significant deflection is precluded until the force applied by the skier exceeds a predetermined amount.

12. The ski of claim 1 wherein the suspension system is configured so that, to cause the ski body to deflect 0.25 inch, it is necessary to apply a force of 20 pounds or greater.

13. The ski of claim 12 wherein the force required for a 1.0 inch deflection is less than three times the force required for a 0.25 inch deflection.

14. The ski of claim 1 wherein the spring rate exhibited during the first 0.25 inch of deflection of the ski body is at least 110% of the spring rate exhibited during the next 0.25 inch of deflection.

15. The ski of claim 1 wherein the suspension system is configured so that the additional force which must be applied to deflect the ski body from 0.25 inches deflection to 0.50 inches deflection is at least 10% less than the force which must be applied to deflect the ski body from 0.0 inches deflection to 0.25 inches deflection.

16. The ski of claim 15 wherein the suspension system is configured so that the force required for a 0.40 inch deflection is at least 10% greater than the additional force required for a 0.80 inch deflection.

17. The ski of claim 1 further comprising a mounting system that attaches the support structure to the ski in a manner that substantially precludes yaw and roll movement between the support structure and the ski body.

18. The ski of claim 1 further comprising a boot binding carried by the support structure.

19. The ski of claim 1 wherein the support structure is releasably attached to the ski body.

20. The ski of claim 1 wherein the ski body defines a running length between the first end and the second end, and the spring is attached between the support structure and a front longitudinal third of the running surface of the ski body.

21. The ski of claim 20 wherein the spring is a leaf spring.

22. The ski of claim 1 wherein the suspension system further includes a second spring attached between the support structure and a rear longitudinal third of the ski body.

23. The ski of claim 22 wherein the second spring is a leaf spring.

24. The ski of claim 1 wherein the ski body comprises a glider.

25. The ski of claim 1 wherein the ski body includes a tunnel edge.

26. The ski of claim 1 wherein the suspension system is configured so that at a predetermined degree of deflection the spring rate exhibited by the ski will be at least 25% less than a maximum spring rate exhibited by the ski at lesser degrees of deflection.

27. The ski of claim 1 wherein the ski body defines a running length between the first end and the second end, and the spring is attached between the support structure and a front longitudinal quarter of the running length of the ski body.

28. The ski of claim 1 wherein the spring is attached between the support structure and a front longitudinal sixth of the running length of the ski body.

29. The ski of claim 27 wherein the second spring is attached between the support structure and a rear longitudinal sixth of the running length of the ski body.

30. The ski of claim 1 wherein the ski body defines a running length between the first end and the second end, and the suspension system further includes a second spring attached between the support structure and a rear longitudinal quarter of the running length of the ski body.

31. The ski of claim 1, wherein the spring rate is measured statically.

32. A ski comprising:

a ski body having a first end and a second end;

a suspension system connected to the ski body so as to apply a vertical downward force to the first and second ends of the ski body, the suspension system comprising a spring applying the vertical downward force to at least one of said ends of the ski body, the spring being under compression when the ski is free of external forces, wherein the suspension system is configured to provide the ski with a spring rate that diminishes as the ski is flexed from a normal unloaded state or a predetermined state of deflection to a state of greater deflection, wherein the suspension system comprises a support structure that is attached to a longitudinally central area of the ski; and a mounting system that attaches the support structure to the ski in a manner that substantially precludes yaw and roll movement between the support structure and the ski body, wherein the mounting system comprises elements configured to allow elastic movement between the support structure and the ski body in the vertical and longitudinal directions as well as around the pitch axis.

33. A ski comprising:

a ski body having a first end and a second end; and a suspension system connected to the ski body so as to apply a vertical downward force to the first and second ends of the ski body, wherein the suspension system is configured to provide the ski with a spring rate that diminishes as the ski is flexed from a normal unloaded state or a predetermined state of deflection to a state of greater deflection, wherein the suspension system is connected to the ski body at a longitudinally central area of the ski by a mounting system being configured to provide the ski with the spring rate that diminishes as the ski is flexed from the normal unloaded state or predetermined state of deflection to the state of greater deflection, wherein the mounting system comprises elastomeric elements configured to allow elastic movement between the suspension system and the ski body.

34. A ski configured to have a spring rate that diminishes as the ski is flexed from a normal unloaded state or a predetermined state of deflection to a state of greater deflection, comprising:

a ski body having a first end and a second end;

a support structure attached to a longitudinally central area of the ski;

a first spring attached between the support structure and a front longitudinal third of the running length of the ski body, the first spring being under compression when no external forces are being applied to the ski; and a second spring attached between the support structure and a rear longitudinal third of the running length of the ski body, the second spring being under compression when no external forces are being applied to the ski, wherein the first and second springs each apply a vertical downward force to the front and rear longitudinal thirds of the running length of the ski body respectively, wherein each of the vertical downward forces applied to the front and rear longitudinal thirds of the running length of the ski body are at least partially determined by a fore/aft rotation of the support structure about a pitch axis relative to the ski body.

35. The ski of claim 34 wherein the first and second springs are leaf springs.

* * * * *

UNITED STATES PATENT AND TRADEMARK OFFICE

CERTIFICATE OF CORRECTION

PATENT NO. : 7,793,969 B2
APPLICATION NO. : 11/283050
DATED : September 14, 2010
INVENTOR(S) : Anton F. Wilson It is certified that error appears in the above-identified patent and that said Letters Patent is hereby corrected as shown below:

Column 16, Line 37, Claim 28, delete "1" and insert --51--, therefore.

Signed and Sealed this
Twenty-eighth Day of December, 2010

David J. Kappos

David J. Kappos
*Director of the United States Patent and Trademark Office*